US005982257A

United States Patent [19]

Vernier

[11] Patent Number: 5,982,257

[45] Date of Patent: Nov. 9, 1999

[54] INTEGRAL ARMATURE RETENTION SPRING FOR ELECTROMAGNETIC RELAYS

[75] Inventor: Richard Allen Vernier, Princeton, Ind.

[73] Assignee: Siemens Electromechanical Components, Inc., Princeton, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,987

[22] Filed: Oct. 31, 1996

[51] Int. Cl.[6] ..... H01H 67/02

[52] U.S. Cl. ..... 335/78; 335/80; 335/274; 335/276

[58] Field of Search ..... 335/78, 80, 83, 335/85, 124, 128, 203, 274, 275, 276

[56] References Cited

U.S. PATENT DOCUMENTS 4,731,597 3/1988 Hinrichs ..... 335/128

FOREIGN PATENT DOCUMENTS

DE 79 32 824 U 5/1980 Germany .
EP 0 246 621 A 11/1987 United Kingdom .
EP 0 347 304 6/1990 United Kingdom .
EP 0 209 837 A 1/1997 United Kingdom .

*Primary Examiner*—Michael L. Gellner
*Assistant Examiner*—Raymond Barrera
*Attorney, Agent, or Firm*—Donald B. Paschburg

[57] ABSTRACT

An electromagnetic relay is provided having a base; a motor assembly mounted on the base, the motor assembly including a coil, a core and a frame; an armature pivotably mounted on the frame; a first electrical contact mounted to the base; a movable elongated member biased against the armature at least at two points such that movement of the armature is restricted and the armature is disposed toward an initial position spaced from the core; and a second electrical contact mounted to the movable elongated member and operatively associated with the first electrical contact.

8 Claims, 4 Drawing Sheets

INTEGRAL ARMATURE RETENTION SPRING FOR ELECTROMAGNETIC RELAYS

BACKGROUND

1. Technical Field

The present disclosure relates to electromagnetic relays, and more particularly to electromagnetic relays having a housing open towards the terminal end of the relay, a magnet system with a coil and a free-floating armature arranged in the upper, closed portion of the housing, and a contact system which is arranged in the lower open portion of the housing and has at least one moveable contact element that is operationally connected to the armature.

2. Background of Related Art

Electromagnetic relays are known, for example, in automotive applications requiring the switching of intermediate level currents, e.g., from 10 to 30 Amps. Such relays sometimes utilize a free-floating armature in a dual-in-line socket mounting arrangement. The relay is normally enclosed in a protective housing to provide shielding from dust and other undesirable particulates.

One problem associated with such free-floating armature or "telephone-style" relays, is that in a particular operating environment, free motion of the relay may produce audible sounds as the assembly experiences shocks and vibrations. Such vibratory operating conditions are common, for example, in automotive applications where these sounds often prove to be unacceptable.

Another problem associated with free-floating armature type relays is that less consistent operation of the relay may result, e.g., if the armature is displaced to one side or the other. In particular, increased friction may arise in the armature hinge structure. Such a condition impedes optimal operation of the relay resulting in a variation of the actuation voltage.

A further problem with free-floating armature relays is that the armature is subject to binding and variable sensitivities resulting from inconsistent air gaps in the armature's hinge structure.

Previous attempts to overcome these problems involved retention of the armature through the use of additional parts. For example, additional springs, mounting brackets as well as associated hardware have been utilized to dampen movement of the free floating armature. However, such remedies increase the time and cost required to manufacture and assemble each unit.

Another problem encountered during the assembly of some conventional relays is that contact forces, gaps and overtravel normally have to be set after the relay is completely assembled. Unfortunately, this is when it is the most difficult to access the parts involved.

Despite these earlier efforts to overcome the problems associated with free-floating armatures, a need still exists for an improved armature retaining arrangement which does not add significantly to the per unit manufacturing and assembly costs of the relays. A need also exists for a modular electromagnetic relay which overcomes the problems associated with making final adjustments and settings to the relay.

SUMMARY

The present disclosure provides an economical solution to the above mentioned drawbacks in previous attempts at retaining free-floating armatures. A benefit of the presently disclosed relay is that the integral armature retention spring reduces audible sounds in applications where the assembly experiences shocks and vibrations, e.g., in automotive environments.

Another benefit of the presently disclosed relay is that the integral armature retention spring prevents displacement of the armature to one side of the assembly or the other and also prevents binding and variable sensitivities resulting from inconsistent air gaps in the armature's hinge structure.

One advantageous feature of the presently disclosed relay is that it facilitates the assembly process by building separate base and motor assemblies as independent modules. One advantage of such a construction is that the terminals are better exposed and thus more accessible. This accessibility has the added benefits of making it easier to remove particulates through the use of blow offs and vacuums as well as facilitating automated assembly and adjustment.

One particular embodiment of the present disclosure provides an electromagnetic relay which includes a base; a motor assembly mounted on the base, the motor assembly including a coil, a core and a frame; an armature pivotably mounted on the frame; a first electrical contact mounted to the base; a movable elongated member biased against the armature at least at two points such that movement of the armature is restricted and the armature is disposed toward an initial position spaced from the core; and a second electrical contact mounted to the movable elongated member and operatively associated with the first electrical contact.

The movable elongated member may be a spring. The movable elongated member may further have a first leg portion biased against the armature and a second leg portion biased against the armature and extending at a predetermined angle away from the first leg portion. The movable elongated member may also include an extended portion displaced from an axis defined by the movable elongated member such that the extended portion forms one of the at least two biasing contacts with the armature. In one aspect of the presently disclosed electromagnetic relay, the extended portion includes a plurality of adjacent sections angularly disposed relative to each other to provide flexibility to the extended portion. Optionally, the extended portion may include a series of adjacent sections angularly disposed relative to each other.

The present disclosure also provides an electromagnetic relay which includes a base; a motor assembly mounted on the base, the motor assembly including a frame, a coil mounted to the frame and a core disposed within the coil; an armature pivotably mounted on the frame and defining a first arm operatively associated with the core, and a second arm, the first and second arms forming a first predetermined angle therebetween; a first electrical contact mounted to the base; a movable elongated member disposed adjacent the armature such that movement of the armature is limited, the movable elongated member defining an armature interface arm and a contact arm, the armature interface and contact arms forming a second predetermined angle therebetween; and a second electrical contact mounted to the movable elongated member and operatively associated with the first electrical contact.

In a preferred embodiment, the second predetermined angle is less than the first predetermined angle, such that the movable elongated member contacts the armature at least at two points therealong. In one aspect of the presently disclosed electromagnetic relay, the armature interface arm biases against the first armature arm with a first force and the contact arm biases against the second armature arm with a second force that is greater than the first force such that the first armature arm is normally biased a predetermined distance away from the core. In a further aspect, the movable elongated member biases the armature such that the armature is disposed at an initial position spaced from the core.

The present disclosure also provides a retention spring for use with an electromagnetic relay having a base, a motor assembly mounted on the base, the motor assembly including a coil, a core and a frame, an armature pivotably mounted on the frame, a first and second electrical contacts operatively mounted to the base, the retention spring includes a first elongated electrically conductive portion disposed in a first plane defining an opening configured and dimensioned to receive an electrical contact in electrically conductive communication therewith; a second elongated electrically conductive portion extending from the first elongated portion and being disposed in a second plane at an angle relative to the first elongated portion; and an electrically conductive finger portion extending from the second elongated portion and disposed at an angle relative to the second elongated portion.

The retention spring may define a first end and a second end and the electrically conductive finger portion defines an opening disposed a distance between the first and second ends of the retention spring, the opening being configured and dimensioned to receive an electrical contact therein. The finger portion may include a series of adjacent sections disposed at an angle relative to each other. The series of angularly disposed sections may include a first section disposed at an angle relative to a second section, wherein the second section defines a planar surface.

A method of assembling an electromagnetic relay is also provided which includes the steps of providing a motor assembly including a frame, a bobbin mounted on the frame, a coil wound about the bobbin, a core disposed within the coil, and an armature pivotably mounted on the frame; providing a base assembly including a base frame member, a first electrical contact mounted to the base frame member, a first terminal member electrically connected to the first electrical contact; a movable elongated member and a second electrical contact mounted to the movable elongated member, a second terminal member electrically connected to the movable elongated member such that the second electrical contact and the movable elongated member are operatively associated with the first electrical contact; superimposing the motor assembly onto the base assembly such that the movable elongated member biases against the armature at least at a first point and a second point, to apply a force on the armature at each of the first and second bias points, the force applied at the first bias point differing from the force applied at the second bias point such that movement of the armature is restricted and the armature is disposed toward an initial position spaced from the core; and securing the motor assembly to the base assembly.

BRIEF DESCRIPTION OF THE DRAWINGS

Various embodiments are described herein with reference to the drawings, wherein.

DETAILED DESCRIPTION OF PREFERRED EMBODIMENTS

Figure 1:
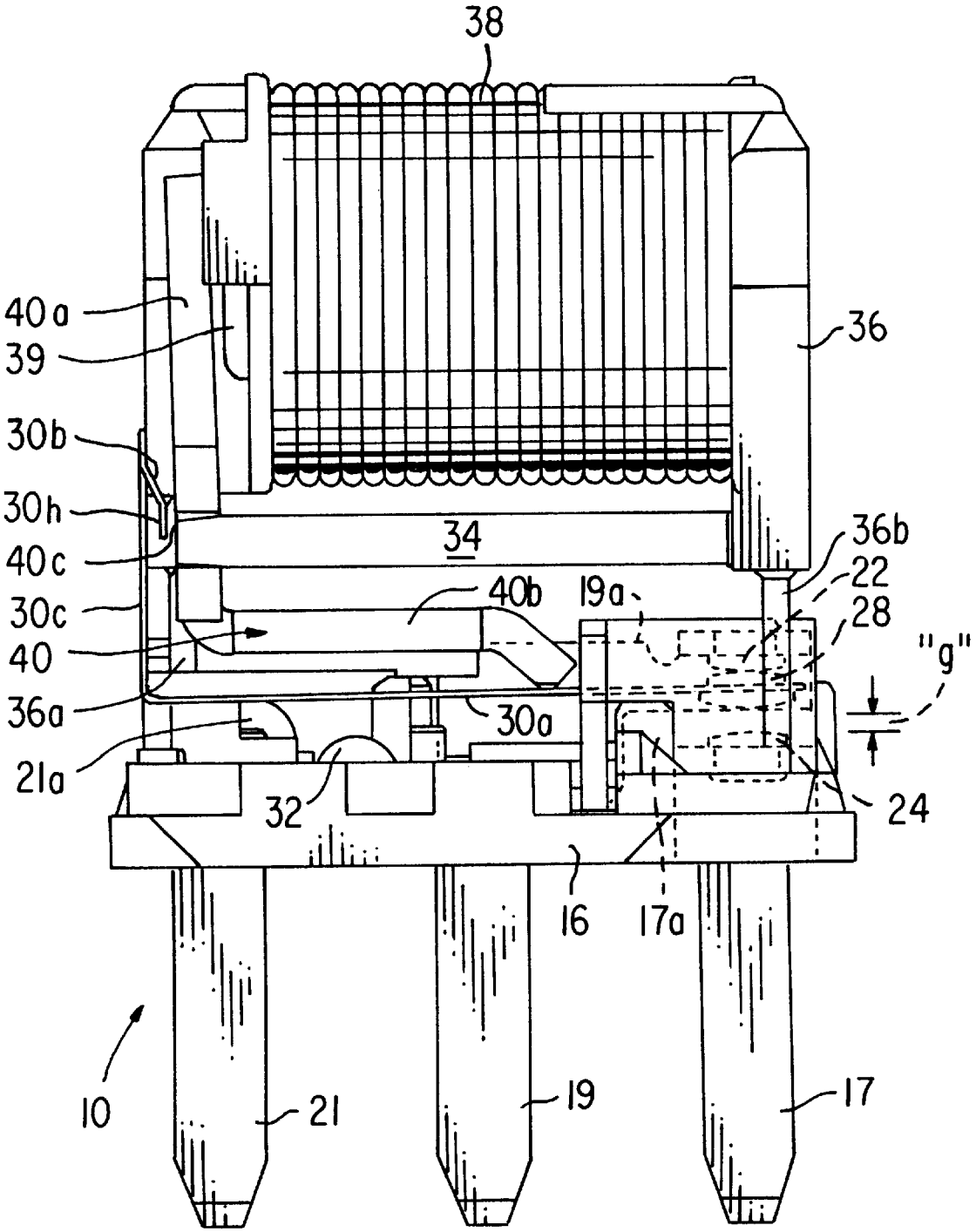
FIG. 1 is an elevation view of an electromagnetic relay with the cover removed, having an integral armature retention spring constructed in accordance with the present disclosure.
Figure 2:
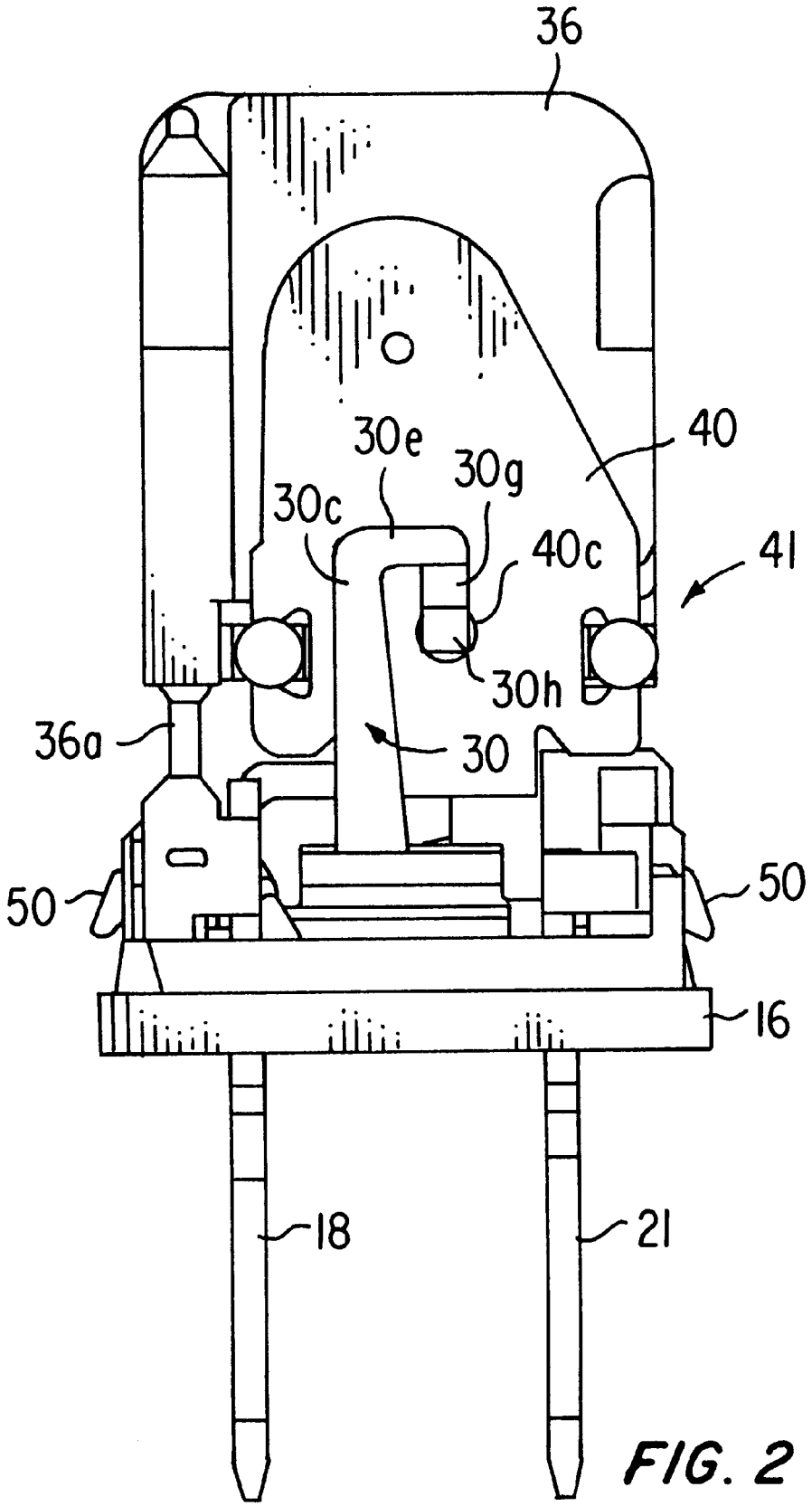
FIG. 2 is a side view of the relay of FIG. 1.
Figure 3:
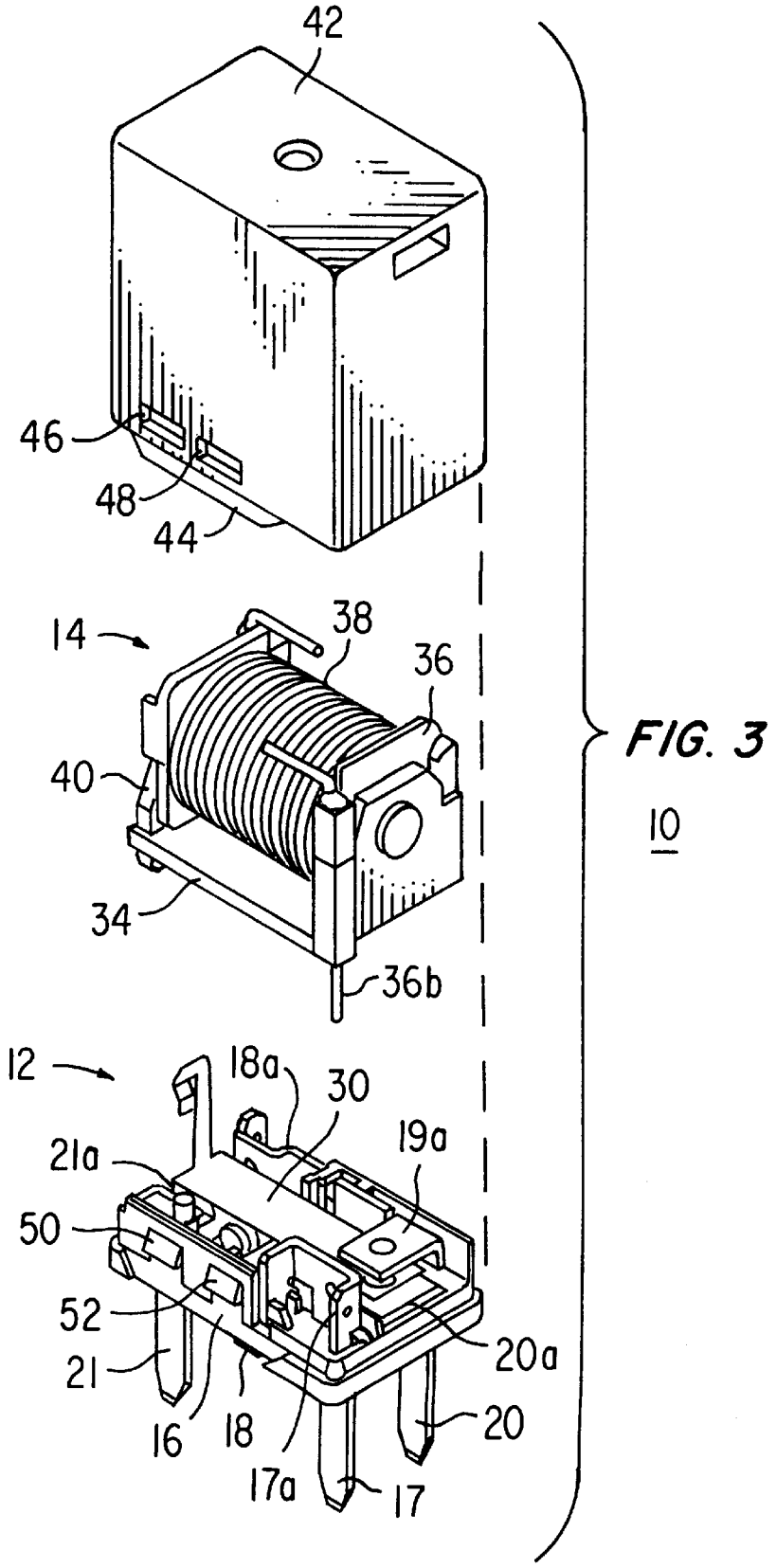
FIG. 3 is a perspective view with parts separated, of the electromagnetic relay of FIG. 1.

Referring now in specific detail to the drawings, in which like reference numerals identify similar or identical elements throughout the several views, and initially to FIGS. 1–3, one embodiment of an electromagnetic relay having an integral armature retention spring constructed in accordance with the present invention is shown as relay 10. The relay 10 is of the type generally known as a "telephone-style" relay and is particularly adapted for use in automotive applications. However, other relay applications which are suitable for exploiting the features and advantages of the presently disclosed modular relay having an integral armature retention spring are also within the scope of the present disclosure. The relay 10 is modular to facilitate efficient, low cost fabrication and assembly. The modularity of the relay 10 is based on two major sub-assemblies, a base assembly 12 and a motor assembly 14.

The base assembly 12 which is a passive structure, includes a frame 16 which may be made from plastic or other non-conductive material suitable for mounting components thereto. The frame 16 may formed, for example, by molding so as to define preformed through holes and steps for receiving the relay components to be mounted thereon. A series of electrically conductive terminals 17, 18, 19, 20, and 21 are mounted in through-holes formed in the frame 16. Teminals 17 and 18 are coil terminals which, as described further herein, are connected to the motor assembly 14.

A first stationary contact designated as normally closed contact 22, which is made of commonly known electrical contact material, is mounted to the upper portion 19*a* of normally closed terminal 19, FIG. 3, which in turn is mounted on the frame 16 through a through-hole. A second stationary contact designated as normally open contact 24 is mounted to the upper portion 20*a* of normally open terminal 20.

A movable contact 28 is mounted in an opening formed near one end of a movable elongated member such as movable spring 30 which is mounted at the other end thereof to the upper portion 21*a* of movable contact terminal 21. A coil suppression resistor 32 is provided to prevent the generation of harmful transient voltages by absorbing some of the stored energy released from the magnetic system when the coil, which is described further herein, is de-energized.

The movable spring 30 which forms an integrated armature retention spring, includes a flexible contact arm 30*a*, an armature interface such as tail spring 30*b*, and a main cantilever section 30*c* which joins the flexible contact arm 30*a* and the tail spring 30*b*. Preferably, the tail spring 30*b* is formed near the end of the main cantilever section 30*c*.

When the various components of the base assembly 12 are put together, a few key operational elements must be set for optimal operation according to the parameters of the relay 10. In particular, the space between movable contact 28 and normally open contact 24, known as the contact gap, shown as "g" in FIG. 1, can be set by bending the upper portion 19*a* of terminal 19 in which normally closed contact 22 is mounted, at a point near the contact itself. Additionally, the spring force which biases contacts 28 and 22 against each other, known as "the normally closed force", is set by grasping the upper portion 21*a* of terminal 21 and bending it so as to introduce a twist in the flexible arm 30*a*. If desired, the base assembly 14 can be tested for forces, contact gap and continuity at this stage to reduce problems during the final assembly stage of the relay 10.

The basic form of the motor assembly 14 will be recognizable to those in the field as having what is considered to be the structure of a "telephone-style" relay. During manufacture, the motor assembly 14, like the base assembly 12, is built independently from the rest of the relay 10 so as to be truly modular. This is particularly advantageous in that the same motor assembly 14 can be used with different base assemblies to accommodate a variety of relay footprint requirements.

The motor assembly 14 includes a frame 34, which receives a bobbin 36 having a coil 38 of conductive wire wound thereon. A core 39 made of ferro-magnetic material is disposed within the center of the bobbin 36. An armature 40 also made of ferro-magnetic material is pivotally mounted on the motor assembly frame 34 about a hinge point 41.

The armature is roughly "L" shaped and includes a magnetically attractable arm portion 40*a* which is substantially vertical and a pusher portion 40*b* which is substantially horizontal. The shape of the armature 40 facilitates translation of the substantially horizontal movement of arm portion 40*a*, induced by the magnetic force created when a current is passed through the coil 38, into substantially vertical movement of pusher portion 40*b* to close the normally open gap between movable contact 28 and stationary contact 24.

The position of the pusher portion 40*b* is preferably adjusted relative to the rest of the motor assembly 14 to reduce the buildup in tolerances through all of the assembled parts. Such an adjustment promotes better control over the motor assembly 14 height and allows a reduction in the overall size of the unit. If desired, the motor assembly 14 can also be tested at this stage for forces at various displacements. This will likely result in a higher yield at the final assembly stage, where the investment in parts and assembly time is the greatest. Additionally, such testing will provide an additional stream of feedback for process control. For example, some latitude could be given to the coil winding process to allow for changes in amp-turns to compensate for variations in the materials and magnetic path.

The particular features of the integral armature retention spring of the present disclosure as embodied in the movable spring 30 will now be addressed in detail. The movable spring 30 combines the functions of a return spring, a movable contact arm and an electrical conductor between either the terminals 21 and 19, or between the terminals 21 and 20. By keeping the current path as short as possible and connected closely to the terminals 19, 20, and 21, improvements in thermal and load carrying performance are achieved. This combination is particularly advantageous in that it eliminates the need for an additional return spring while avoiding the complication of forming the movable spring through the three or four critical bends usually required to attach the armature to the frame for a clapper-style relay.

The movable spring 30 preferably consists of a blade of thin flexible highly conductive material attached at one end to the upper portion 21*a* of terminal 21, e.g., by welding, and retains the movable contact 28 at the opposite end in an opening formed therein. The movable contact 28 may optionally be double headed or single headed, as required, to produce a form C (single pole double throw) or form A (single pole single throw) structure, respectively. Preferably the movable spring 30 is formed by stamping and forming it on the same die from a metallic sheet material. This reduces the amount of fabrication, handling and assembly required by integrating the tail spring 30*b* with the flexible contact arm 30*a*.

The movable spring 30 also eliminates mechanical staking operations usually performed to achieve this attachment of the armature to the frame in conventional assembly of relays. The presence of these mechanical stakes in the current path can be a source of additional heating as well as a detriment to reliability. For example, movement of the parts or relaxation of stresses can cause a reduction in the compressive force at the joint. Additionally, each mechanical joint is subject to corrosion. Instead, the movable spring is directly welded to the upper portion 21*a* of the terminal 21.

Figure 4:
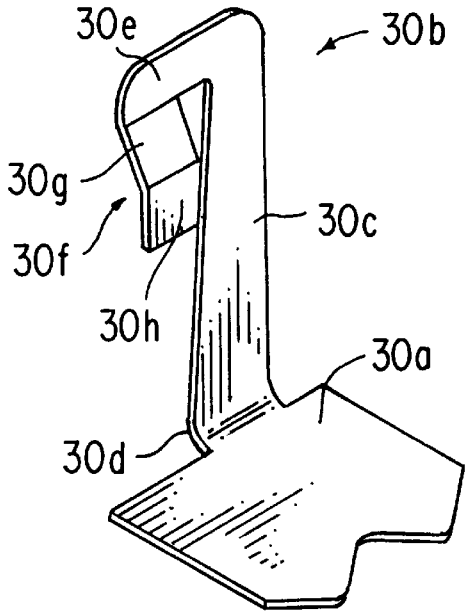
FIG. 4 is a perspective view of one alternative embodiment of an integral armature retention spring constructed in accordance with the present disclosure.

Referring now to FIG. 4, more detailed features of the integral retainer spring of the present disclosure will now be described as featured on movable spring 30. Movable spring 30 includes a radiused portion 30*d* which separates the flexible contact arm 30*a* and the main cantilever section 30*c*. The radiused portion 30*d* prevents excessive concentration of stress when subjected to the static loads associated with the initial forming and the initial bias as well as the dynamically varying loads resulting from relay operation and shock and vibration. The radius may be very small or non-existent depending upon the materials and the expected loading.

Most of the spring action imparted by movable spring 30 on the armature is provided by the main cantilever section 30*c*. The range of motion expected in the armature during operation must be taken into account as well as any loss of displacement expected as a result of wear to maintain the necessary load. This dictates keeping the spring rate as low as possible while still achieving the desired retention and dampening of armature movement. By keeping the spring rate low enough post assembly adjustments otherwise necessitated by normal tolerances in parts and assembly may be avoided.

To determine the spring rate, only the length and width are available as variables as the thickness and material are already set by the primacy of the function of the flexible contact arm 30*a*. Since the spring rate is more heavily influenced by the spring's length than its width, it is desirable to make the effective length of the spring longer than the actual linear space available given the constraints imposed by the relay enclosure. Further, it is sometimes necessary to apply the armature load at a point close to the flexible contact arm 30*a*.

Generally, it is necessary to apply the load close to the armature's hinge point 41 (FIG. 2) to reduce the effect of the retention force on the normally closed contact force of the relay 10. Keeping the load application point close to the hinge point 41 reduces the leverage and allows the use of high retention forces. In order to increase the effective length of the tail spring 30*b* while keeping the it close to the flexible contact arm 30*a*, the end of movable spring 30 is formed such that it is redirected back toward radiused portion 30*d*. This is accomplished by stamping the sheet material to form sections 30*e* and 30*f*. These sections can be straight as shown or full radii producing a sort of spiral. Additionally, section 30*f* is preferably bent relative to section 30*e* during the stamping process to form a compound bend consisting of sections 30*g* and 30*h*. Section 30*g* acts as a transitional surface to section 30*h* to displace section 30*h* closer to a raised portion 40*c* formed on the armature. Section 30*h* is preferably planar so as to form a pad at the end of movable spring 30 to bias against the raised portion 40*c*. The use of such a flat pad reduces friction and simplifies implementation of the tail spring 30*b*.

Figure 5:
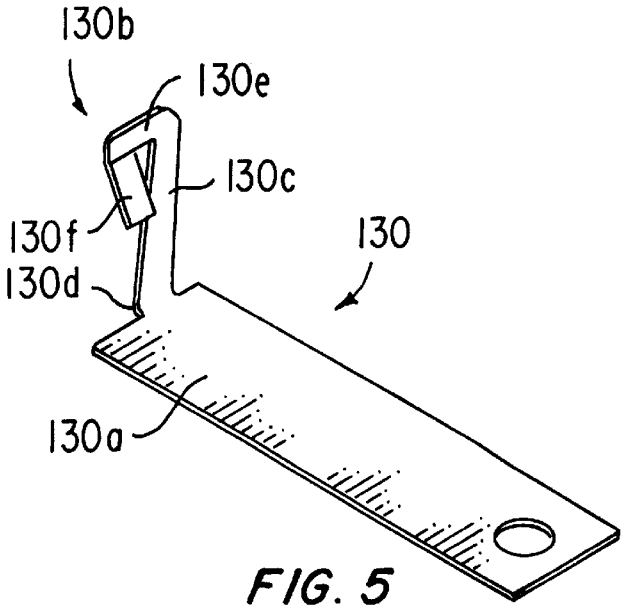
FIG. 5 is a partial perspective view of another alternative embodiment of the integral armature retention spring of the present disclosure.

Referring to FIG. 5, a further alternative embodiment of the integral armature retention spring shown as movable spring 130 is shown which includes a turn around portion similar to that featured in movable spring 30 of FIG. 4. Movable spring 130 is roughly similar to movable spring 30 and is mounted to the base assembly 12 in the same manner as described above for movable spring 30. Accordingly, similar sections and features are labeled in similar fashion as for movable spring 30 but incremented by 100, e.g., movable spring 30 corresponds to movable spring 130. Instead of the complex bend formed on the tail spring 30*b* of the embodiment of FIG. 4, tail spring 130*b* is provided with a single bend which may be preferable in a particular application.

Figure 6:
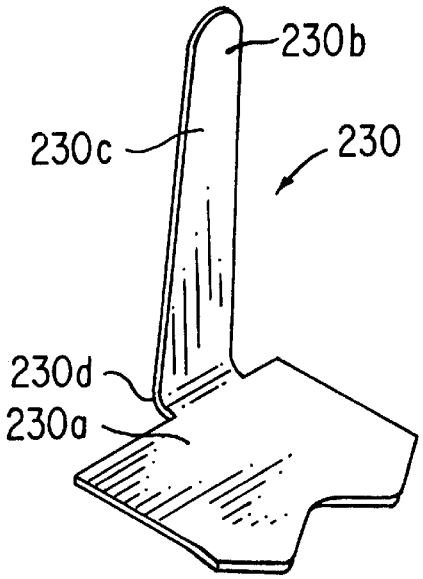
FIG. 6 is a partial perspective view of a further alternative embodiment of the integral armature retention spring of the present disclosure.

Referring to FIG. 6, yet another alternative embodiment of the integral armature retention spring, shown as movable spring 230 is shown which includes a flexible contact arm 230*a* and an armature interface portion 230*b* formed at the end of a main cantilever section 230*c*. The armature interface portion 230*b* is mounted in a base assembly similar to base assembly 12 having an armature mounted (as shown in FIGS. 1–3). The tail spring 230*b*, similar to tail springs 30*b* and 130*b*, biases against the armature due to an inward bend formed in the main cantilever section 230*c*. This bias serves to stabilize or dampen a portion of the free-floating movement of the armature. Tail spring 230*b* however terminates in a straight section as compared with the turn-around sections of tail springs 30 and 130.

Referring again to FIGS. 1–3, assembly of the relay 10 is achieved by positioning motor assembly 14 over base assembly 12 such that the bobbin terminals 36*a* and 36*b* are axially aligned with the upper portions 18*a* and 17*a* of coil terminals 18 and 17, respectively. With the base assembly and motor assembly independently adjusted, the two can be brought together in such a manner that the assembly stage sets the overtravel and normally open contact force, which is the force that holds the armature contact arm 40*a* away from the core 39. By holding the armature contact arm 40*a* against the head of core 39 as the motor assembly 14 is brought into position, the armature pusher 40*b* will cause the movable spring 30 to deflect in the same manner as it does during normal operation. Continuity between terminals 20 and 21 can be monitored while the two assemblies are brought together.

Once a connection is established, the motor assembly 14 is moved an additional amount corresponding to the overtravel plus a compensation factor to accommodate for flex in the system. As the motor assembly 14 reaches the desired position, twin welders can be fired to secure bobbin terminals 36*a* and 36*b* to coil terminals 18*a* and 17*a*, respectively, to lock the relative adjustment between the base assembly and the motor assembly. This two point attachment will be sufficient for handling through the assembly process. Additional stability is provided by features which may be molded inside a cover 42 to prevent excessive motion of the motor assembly 14.

The cover 42 is provided with an alignment tab 44 to ensure proper positioning and orientation of the cover 42 relative to the frame 16 of the base assembly 12. Additionally, the cover has mounting holes 46 and 48 formed adjacent the alignment tab 44. The mounting holes 46 and 48 receive wedge shaped locking tabs 50 and 52, respectively. As the cover 42 is positioned over the joined base and motor assemblies 12 and 14, the locking tabs 50 and 52 cam the inside surface of the cover outward until the tabs 50 and 52 become aligned with mounting holes 46 and 48 and snap into the holes to complete assembly of the relay 10. Optionally, the locking tabs 50 and 52 may be flexible so that upon assembly, the tabs flex inward until they snap into position in mounting holes 46 and 48.

In operation of the relay 10, the coil 38, which is wound on the bobbin 36, produces a magnetic field when made to carry an electric current. This magnetic field is aligned axially with the bobbin 36 and produces a magnetic flux which is confined mostly to the magnetic path which includes the core 39, the armature 40 and the motor assembly frame 34. With the armature 40 in the open position, as shown in FIG. 1, a potential energy exists which reduces the reluctance in the magnetic path. Most of the reluctance is present in the gap between the armature arm 40*a* and the core 39. The energy in the magnetic field causes the armature arm 40*a* to move toward the core 39. The armature 40 is constrained at the hinge point 41 to allow rotation only. Consequently, the armature pusher 40*b* moves as well, resulting in an approximately 90 degree change in the direction of motion. Thus, the horizontal action of the armature arm 40*a* is redirected downward to act against the movable spring 30. As the pusher portion 40*b* presses against the movable spring 30, the spring begins to bend causing movable contact 28 to move away from normally closed stationary contact 22. Accordingly, the electrical circuit from terminal 21 to terminal 19 is interrupted.

As motion of the armature pusher portion 40*b* continues, the movable contact 28 impinges upon normally open stationary contact 24 and establishes a new conductive path from movable contact terminal 21 to the normally open contact terminal 20. The relay 10 is preferably adjusted in the manufacturing process so as to still have a small gap between the armature arm 40*a* and the core 39 at this point. As a result, continued motion of the armature 40 produces a bowing in the movable spring 30 and a build up in force acting between the contacts 28 and 24. until the armature arm 40*a* actually seats against the core 39. This additional motion is usually referred to as "overtravel". The overtravel can be set to a predetermined value by controlling the height of the motor assembly 14 above the base assembly 12.

With the armature arm 40*a* held closed against the core, lowering the motor assembly 14 will cause the pusher 40*b* to bias increasingly against the movable spring 30 thus producing additional force on the spring and deflection thereof (overtravel). Besides producing contact force through arm deflection, overtravel is also required to maintain a minimum contact force given variations in parts and assembly along with changes due to contact material being lost as a consequence of normal electrical operation.

At de-energization, the coil current is interrupted and the magnetic field collapses. The collapsing field results in an induced current which flows through the resistor 32 until the stored energy is expended. As the magnetic field strength drops, so does the force acting between the armature arm 40*a* and the core 39 until at some point the force is no longer sufficient to maintain the contacts 28 and 24 in a closed state. Thus, the relay 10 will return to its initial state.

It will be understood that various modifications may be made to the embodiments disclosed herein. Therefore, the above description should not be construed as limiting, but merely as exemplifications of preferred embodiments. Those skilled in the art will envision other modifications within the scope and spirit of the claims appended hereto.

What is claimed is:

1. An electromagnetic relay which comprises:

a base;

a motor assembly having a longitudinal axis associated therewith, the motor assembly being mounted on the base and including a coil, a core and a frame; a substantially L-shaped armature having a first arm extending substantially perpendicular to the longitudinal axis and a second arm extending substantially parallel to the longitudinal axis, the armature being pivotably mounted on the frame about a hinge point;

a first electrical contact mounted to the base;

a movable elongated member having an armature interface arm biased against the first armature arm at least at one point and a contact arm biased against the second armature arm at least at one point such that movement of the armature is restricted and the first armature arm is disposed toward an initial position spaced from the core, wherein the armature interface arm includes a plurality of adjacent sections at an end thereof for providing flexibility to the armature interface arm and for providing the bias contact point between the armature interface arm and the first armature arm, the adjacent sections being angularly disposed relative to each other and being formed such that the adjacent sections are re-directed back towards the contact arm from the end of the armature interface arm;

and a second electrical contact mounted to the contact arm of the movable elongated member and operatively associated with the first electrical contact.

2. An electromagnetic relay according to claim 1, wherein the elongated member is a spring.

3. An electromagnetic relay according to claim 1, wherein the plurality of adjacent sections comprises a series of adjacent sections having an initial section, a transitional section and a terminal section for contacting the first armature arm, the initial and terminal sections being spaced a distance from each other by the transitional section such that longitudinal axes of the initial and terminal sections are substantially parallel.

4. An electromagnetic relay, which comprises:

a base;

a motor assembly mounted on the base, the motor assembly including a frame, a coil mounted to the frame and a core disposed within the coil;

an armature pivotably mounted on the frame about a hinge point and defining a first arm operatively associated with the core, and a second arm, the first and second arms forming a first predetermined angle therebetween, a first electrical contact mounted to the base;

a movable elongated member disposed adjacent the armature such that movement of the armature is limited, the movable elongated member defining an armature interface arm which is operatively associated with the first armature arm and a contact arm which is operatively associated with the second armature arm, the armature interface and contact arms forming a second predetermined angle therebetween, wherein the armature interface arm includes a plurality of adjacent sections at an end thereof for providing flexibility to the armature interface arm, the adjacent sections being angularly disposed relative to each other and being formed such that the adjacent sections are re-directed back towards the contact arm from the end of the armature interface arm; and a second electrical contact mounted to the contact arm of the movable elongated member and operatively associated with the first electrical contact.

5. An electromagnetic relay according to claim 4, wherein the second predetermined angle is less than the first predetermined angle, such that the movable elongated member contacts the armature at least at two points therealong.

6. An electromagnetic relay according to claim 4, wherein the armature interface arm biases against the first armature arm with a first force and the contact arm biases against the second armature arm with a second force that is greater than the first force such that the first armature arm is normally biased a predetermined distance away from the core.

7. An electromagnetic relay according to claim 4, wherein the movable elongated member biases the armature such that the armature is disposed at an initial position spaced from the core.

8. An electromagnetic relay according to claim 4, wherein the plurality of adjacent sections comprises a series of adjacent sections having an initial section, a transitional section and a terminal section for contacting the first armature arm, the initial and terminal sections being spaced a distance from each other by the transitional section such that longitudinal axes of the initial and terminal sections are substantially parallel.

* * * * *